US008548342B2

(12) United States Patent
Lee et al.

(10) Patent No.: US 8,548,342 B2
(45) Date of Patent: Oct. 1, 2013

(54) CUSTOMER REPLACEABLE UNIT MONITOR (CRUM) UNIT, REPLACEABLE UNIT AND IMAGE FORMING APPARATUS COMPRISING THE CRUM UNIT, AND UNIT DRIVING METHOD THEREOF

(75) Inventors: Jae-sung Lee, Hwaseong-si (KR); Yong-geun Kim, Suwon-si (KR); Yoon-tae Lee, Seoul (KR)

(73) Assignee: Samung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/543,952

(22) Filed: Jul. 9, 2012

(65) Prior Publication Data

US 2012/0275800 A1 Nov. 1, 2012

Related U.S. Application Data

(63) Continuation of application No. 13/226,920, filed on Sep. 7, 2011, now Pat. No. 8,233,812, which is a continuation of application No. 12/389,595, filed on Feb. 20, 2009, now Pat. No. 8,036,548.

(30) Foreign Application Priority Data

Jul. 31, 2008 (KR) ..... 2008-75266

(51) Int. Cl.
*G03G 15/00* (2006.01)

(52) U.S. Cl.
USPC ..... 399/44; 399/110

(58) Field of Classification Search
USPC ..... 399/44, 94, 97, 110, 111, 116, 119, 399/115, 121, 122, 123
See application file for complete search history.

(56) References Cited

U.S. PATENT DOCUMENTS

| | | | | |
|---|---|---|---|---|
| 6,181,885 | B1 | 1/2001 | Best et al. | |
| 6,532,351 | B2 | 3/2003 | Richards et al. | |
| 6,940,613 | B1 | 9/2005 | Beard et al. | |
| 6,985,675 | B2 | 1/2006 | Guddanti | |
| 8,036,548 | B2 * | 10/2011 | Lee et al. | 399/44 |
| 2006/0153578 | A1 * | 7/2006 | May | |
| 2008/0166144 | A1 * | 7/2008 | Lee et al. | |

FOREIGN PATENT DOCUMENTS

| | | | |
|---|---|---|---|
| JP | 06027792 | A * | 2/1994 |
| JP | 2005195886 | | 7/2005 |
| JP | 2006-163143 | | 6/2006 |
| JP | 2005163143 | | 6/2006 |

OTHER PUBLICATIONS

International Search Report and Written Opinion issued Jul. 31, 2009 in International Application No. PCT/KR2009/001817.
Korean Office Action issued in Korean Application No. 10-2008-0075266 on Aug. 22, 2012.

* cited by examiner

*Primary Examiner* — Susan Lee
(74) *Attorney, Agent, or Firm* — Stanzione & Kim, LLP

(57) ABSTRACT

An image forming apparatus including a replaceable unit to participate in an image forming job, and a consumer replaceable unit monitor (CRUM) unit mountable to the replaceable unit.

4 Claims, 6 Drawing Sheets

CUSTOMER REPLACEABLE UNIT MONITOR (CRUM) UNIT, REPLACEABLE UNIT AND IMAGE FORMING APPARATUS COMPRISING THE CRUM UNIT, AND UNIT DRIVING METHOD THEREOF

CROSS-REFERENCE TO RELATED APPLICATIONS

This application is a Continuation Application of prior application Ser. No. 13/226,920, filed on Sep. 7, 2011 now U.S. Pat. No. 8,233,812 in the United States Patent and Trademark Office which is a Continuation of U.S. application Ser. No. 12/389,595, filed on Feb. 20, 2009, now U.S. Pat. No. 8,036,548, in the United States Patent and Trademark Office, which claims priority under 35 U.S.C. §119(a) from Korean Patent Application No. 10-2008-0075266, filed on Jul. 31, 2008, in the Korean Intellectual Property Office, the disclosure of which is incorporated herein by reference in its entirety.

BACKGROUND OF THE INVENTION

1. Field of the Invention

The present general inventive concept relates to a customer replaceable unit monitor (CRUM) unit, and a replaceable unit and an image forming apparatus comprising the CRUM unit, and a unit driving method thereof. More particularly, the present general inventive concept relates to a CRUM unit and a replaceable unit capable of computing driving conditions individually, an image forming apparatus for driving the replaceable unit based on the computed driving conditions, and a unit driving method thereof.

2. Description of the Related Art

The use of computers and computer components such as printers, scanners, copiers, or multifunction units has increased over the years.

Image forming apparatuses use ink or toner to print images on print sheets. Ink or toner is a consumable, which is exhausted at the end of a predetermined life and thus has to be replaced. Most of the time, it is not ink or toner, but a unit containing the ink or toner that is replaced. This type of unit which can be replaced during use of an image forming apparatus is called a consumable or replaceable unit.

In addition to the ink or toner unit mentioned above, the replaceable unit includes other units which are not exhausted, but may deteriorate from use or over time and thus cannot render high quality printouts at the end of their lives. For example, a laser image forming apparatus employs an electric charging unit, a transfer unit, and a fusing unit therein, and in each of the units, rollers or belts may wear out or deteriorate over time. Therefore, a good quality image cannot be produced. In order to ensure a good quality image, the replaceable units need to be replaced at appropriate intervals.

Meanwhile, the replaceable units are affected by the ambient temperature. In particular, components such as an organic photo conductor (OPC) housed inside a developing unit, or a doctor blade provided close to a developing roller, are sensitive to a temperature factor. In this case, the quality of an output image depends on changes in ambient temperature.

Accordingly, a conventional image forming apparatus employs a thermistor in the set to check the temperature changes, so that the operations of the respective replaceable units can be controlled based on the temperature changes. However, due to several limitations of the replaceable units, such as limited structure or a need to interface with the main controller in the image forming apparatus, thermistors are installed in a few limited places and cannot check the temperature accurately.

In addition, since detected temperatures can have different values depending on the places where the thermistors are installed, it is also difficult to determine the optimum driving conditions of the replaceable units accurately.

Furthermore, since the main controller is required to control an image forming process based on the temperature checks received from the thermistors, the main controller can have increased computational load, and thus can be delayed in carrying out control programs.

SUMMARY OF THE INVENTION

The present general inventive concept provides a customer replaceable unit monitor (CRUM) unit and a replaceable unit, capable of computing driving conditions individually, an image forming apparatus using such units, and a unit driving method thereof.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a replaceable unit to participate in an image forming job of an image forming apparatus, which includes a storage unit to store therein a driving condition corresponding to an operation environment, a detecting unit to monitor the operation environment, a controlling unit to detect a corresponding driving condition from the storage unit, if the detecting unit detects the driving environment, and an interface unit to provide a main body of the image forming apparatus with the detected corresponding driving condition.

The operation environment may include at least one of an internal temperature and an external temperature of the replaceable unit, and the driving conditions may include a driving voltage condition of the replaceable unit.

The storage unit, the detecting unit, the controlling unit, and the interface unit may be mounted to a customer replaceable unit monitor (CRUM) unit which is housed within the replaceable unit.

The detecting unit may include at least one diode or at least one transistor, and check a potential difference between one and the other ends of the at least one diode, or a change in base-emitter voltage of the at least one transistor, to detect temperature information.

The detecting unit may include a tamper detector to monitor the operation environments and block an attempt to physically tamper with the replaceable unit.

The controlling unit may include a central processing unit (CPU) to execute its own operating system (O/S) to control the operations of the storage unit, the tamper detector and the interface unit.

The foregoing and/or other features and utilities of the present general inventive concept may also be achieved by providing an image forming apparatus, which includes at least one replaceable unit to participate in an image forming job of the image forming apparatus, and a main controller to communicate with the at least one replaceable unit and to control the image forming job. The at least one replaceable unit may monitor an operation environment, and provide the main controller with an individual driving condition which corresponds to the operation environment, and the main controller may drive the at least one replaceable unit individually, in accordance with the driving condition provided.

The replaceable unit may include a storage unit to store the driving condition corresponding to the operation environment, a detecting unit to monitor the operation environment, a controlling unit to detect a corresponding driving condition from the storage unit, if the detecting unit detects the operation environment, and an interface unit to provide the main controller with the detected corresponding driving condition.

The operation environments may include at least one of an internal temperature and an external temperature of the replaceable unit, and the driving conditions may include a driving voltage condition of the replaceable unit.

The storage unit, the detecting unit, the controlling unit, and the interface unit may be mounted to a customer replaceable unit monitor (CRUM) unit which is housed within the replaceable unit.

The detecting unit may include at least one diode or at least one transistor, and check a potential difference between one and the other ends of the at least one diode, or a change in base-emitter voltage of the at least one transistor, to detect temperature information.

The detecting unit may include a tamper detector to monitor the operation environments and block an attempt to physically tamper with the replaceable unit.

The controlling unit may include a central processing unit (CPU) to execute an operating system (O/S) to control the operations of the temper detector and the interface unit.

The foregoing and/or other features and utilities of the present general inventive concept may also be achieved by providing a consumer replaceable unit monitor (CRUM) unit mountable to a replaceable unit which participates in an image forming job of an image forming apparatus, in which the CRUM unit may include a storage unit to store therein a driving condition set for the replaceable unit, the driving condition corresponding to an operation environment, a detecting unit to monitor the operation environment, a controlling unit to detect a corresponding driving condition from the storage unit, if the detecting unit detects the driving environment, and an interface unit to provide a main body of the image forming apparatus with the detected corresponding driving condition.

The operation environments may include at least one of an internal temperature and an external temperature of the replaceable unit, and the driving conditions comprise a driving voltage condition of the replaceable unit.

The controlling unit may include a central processing unit (CPU) to execute an operating system (O/S) to control the operations of the storage unit, the detecting unit, and the interface unit.

The foregoing and/or other features and utilities of the present general inventive concept may be achieved by providing a unit driving method of an image forming apparatus which includes at least one replaceable unit, and a main controller to communicate with the at least one replaceable unit and to control an image forming job, in which the unit driving method may include monitoring, at the at least one replaceable unit, an operation environment, detecting an individual driving condition which corresponds to the monitored operation environment, providing the main controller with the detected individual driving condition, and driving, at the main controller, the at least one replaceable unit individually according to the provided driving condition.

The detecting may include detecting from a storage unit a driving voltage condition which corresponds to the monitored operation environment, the storage unit having stored therein preset driving voltage conditions which correspond to the operation environment of each of the at least one replaceable unit, and the operation environment comprises at least one of an internal temperature and an external temperature of the replaceable unit.

The monitoring at the at least one replaceable unit may be performed by a tamper detector which is housed in the replaceable unit to block an attempt to physically tamper with the replaceable unit.

The replaceable unit may include a central processing unit (CPU) to execute an operating system (O/S) to control the operations of the replaceable unit.

As a result, each of the at least one replaceable unit can be driven under the optimum driving condition, to minimize computational load.

The foregoing and/or other aspects features and utilities of the present general inventive concept may also be achieved by providing a replaceable unit in an image forming apparatus having a main controller, the replaceable unit including a detecting unit to detect an operation environment of the replaceable unit, and a controller unit to determine a driving condition corresponding to the detected operation environment and to provide the driving condition to the main controller to drive the replaceable unit according to the driving condition, wherein the detecting unit includes a tamper detector to detect attempts to tamper with the replaceable unit.

The replaceable unit may further include a storage unit to store the determined driving condition and information related to the replaceable unit.

The operation environment may be at least one of a voltage, a temperature, a pressure, a light frequency, and an amount of light.

The controller unit may run an operating system independent of the main controller, and may run an operating system independent of the main controller to control the detecting unit.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
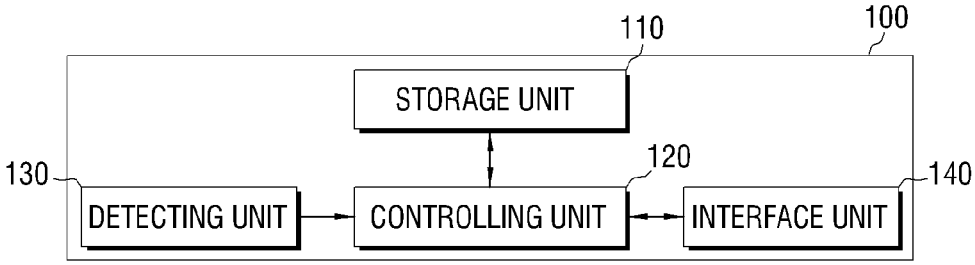
FIG. 1 illustrates a block diagram of a replaceable unit according to an exemplary embodiment of the present general inventive concept.

Reference will now be made in detail to exemplary embodiments of the present general inventive concept, examples of which are illustrated in the accompanying drawings, wherein like reference numerals refer to the like elements throughout. The exemplary embodiments are described below in order to explain the present general inventive concept by referring to the figures.

FIG. 1 illustrates a block diagram of a replaceable unit 100 according to an exemplary embodiment of the present general inventive concept. The 'replaceable unit' herein refers to a unit which is provided inside the image forming apparatus, to participate in an image forming job, and which is replaceable by a user or a manufacturer. For example, the replaceable unit 100 may include a developing unit, a charging unit, a transfer unit, a fusing unit, an organic photo conductor (OPC), a laser scanning unit (LSU), a paper feeding roller, or a feeding roller.

Referring to FIG. 1, the replaceable unit 100 includes a storage unit 110, a control unit 120, a detecting unit 130, and an interface unit 140.

The storage unit 110 may store therein driving conditions of the replaceable unit 100 which correspond to predetermined operation environments. The 'operation environments' may include temperature inside or outside the replaceable unit 100, and the 'driving conditions' may include a driving voltage factor (e.g., voltage size, frequency, or duty ratio in case of pulse) which is optimized for the temperature.

The driving voltage factors according to operation environments may be exemplified as illustrated below.

TABLE 1

| Temperature | Voltage |
|---|---|
| Less than 0° C. | a[v] |
| 0~10° C. | b[v] |
| 10~20° C. | c[v] |
| 20~30° C. | d[v] |
| 30~40° C. | e[v] |
| 40° C. or above | f[v] |

As explained above, the storage unit 110 may store therein predetermined information such as, for example, the optimum driving voltage size, which corresponds to each of the temperature ranges. A manufacturer of the image forming apparatus or replaceable unit 100 may carry out tests a plurality of times with respect to various combinations of the operation environments and driving conditions so as to obtain averages of the driving conditions suitable for each of the operation environments and record the obtained results in the storage unit 110.

Additionally, the storage unit 110 may record therein various types of information regarding the replaceable unit 100. The information may include identification information such as manufacturer, date and time of manufacture, serial number, or model name, and status information such as programs, electronic signatures and status of use (e.g., number of printed pages, number of printable pages remaining, or amount of remaining toner).

For example, the storage unit 110 may store a table exemplified below.

TABLE 2

| General Information | |
|---|---|
| OS Version | CLP300__V1.30.12.35 02-22-2007 |
| SPL-C Version | 5.24 06-28-2006 |
| Engine Version | 6.01.00(55) |
| USB Serial Number | BH45BAIP914466B. |
| Set Model | DOM |

TABLE 2-continued

| | |
|---|---|
| Service Start Date | 2007-09-29 |
| Option | |
| RAM Size | 32 Mbytes |
| EEPROM Size | 4096 bytes |
| USB Connected (High) | |
| Consumables Life | |
| Total Page Count | 774/93 Pages(Color/mono) |
| Fuser Life | 1636 Pages |
| Transfer Roller Life | 864 Pages |
| Tray1 Roller Life | 867 Pages |
| Total Image Count | 3251 Images |
| Imaging Unit/Deve Roller Life | 61 Images/19 Pages |
| Transfer Belt Life | 3251 Images |
| Toner Image Count | 14/9/14/19 Images(C/M/Y/K) |
| Toner Information | |
| Toner Remains Percent | 99%/91%/92%/100% (C/M/Y/K) |
| Toner Average Coverage | 5%/53%/31%/3% (C/M/Y/K) |
| Consumables Information | |
| Cyan Toner | SAMSUNG(DOM) |
| Magenta Toner | SAMSUNG(DOM) |
| Yellow Toner | SAMSUNG(DOM) |
| Black Toner | SAMSUNG(DOM) |
| Imaging unit | SAMSUNG(DOM) |
| Color Menu | |
| Custom Color | Manual Adjust(CMYK: 0, 0, 0, 0) |
| Setup Menu | |
| Power Save | 20 Minutes |
| Auto Continue | On |
| Altitude Adj. | Plain |

As shown in Table 2, the storage unit 110 may record therein not only the relation between operation environments and driving conditions (Table 1), but also information such as details about the unit, lifespan of the consumables, other information related to the consumables or the unit, or setup menu (Table 2).

The detecting unit 130 monitors operation environments of the replaceable unit 100. For example, the detecting unit 130 may be provided as a tamper detector to block any attempt to physical tamper with the replaceable unit 100.

The tamper detector can protect the system from various attempts at physical hacking, that is, from tampering. The tamper detector may monitor operation environments such as voltage, temperature, pressure, and light (amount or frequency), and may erase data or physically shield data if an attempt at tampering or hacking, such as Decap, is detected. If the tamper detector is employed as the detecting unit 130, the tamper detector can provide the controlling unit 120 with information such as temperature information obtained from the tamper detecting operation. Accordingly, the controlling unit 120 can be informed of the operation environments.

The detecting unit 130 may check the operative characteristics of a diode or transistor which is housed inside or near the detecting unit 130 to detect the temperature information. For example, the PN bonding of semiconductor has a forward and a backward direction voltage which is dependent on temperature. Accordingly, a diode or transistor having PN bonding may be used as a temperature element.

If a diode is used, temperature information can be checked from the detected size of the forward direction voltage or backward direction voltage. If a transistor such as an npn transistor is used, voltage between base and emitter can be detected when a predetermined collector current (lc) flows to check the temperature information.

If the detecting unit 130 detects temperature information from the operative characteristics of the diode or transistor, since the detected value can correspond to a voltage value, the detected value can be directly used as the operation environments. That is, the detected value need not be converted to be used as the operation environment. Accordingly, while Table 1 illustrates an example where the temperature and voltage conditions are recorded, such type of database may not be used, and instead a relation between detected voltages and voltage conditions may be stored in the storage unit 110 and used.

The detecting unit 130 may use a separate temperature sensor such as a thermistor.

If the detecting unit 130 detects the operation environments, the controlling unit 120 can check the database of the storage unit 110 for a driving condition that corresponds to the detected operation environment. For example, if the detecting unit 130, using a transistor, detects base-emitter voltage as $V_{BE}$=0.725[v], and 21° C. is the temperature that corresponds to the detected voltage, the controlling unit 120 may determine d[v] as the driving condition based on the database shown in Table 1.

Meanwhile, considering that the diode or transistor is generally integrated on a board provided in the replaceable unit 100, the temperature obtained through this component may be higher than the actual ambient temperature. Therefore, if a diode or transistor is used, it is desirable to record a converted driving condition that corresponds to the actual temperature measured a predetermined distance away from the board.

The interface unit 140 operates to connect the controlling unit 120 to a main controller of the image forming apparatus. Through the interface unit 140 the controlling unit 120 may provide the detected driving condition to the main body, more specifically, to the main controller (not illustrated) of the image forming apparatus. Accordingly, the main controller is capable of driving a corresponding replaceable unit 100 in accordance with the driving condition provided by the controlling unit 120.

The interface unit 140 may be embodied as a serial interface or a wireless interface. A serial interface provides advantage of cost reduction, since this uses fewer signals than the parallel interface, and is particularly suitable for a noise-ridden operation environment such as a printer.

The controlling unit 120 may execute its own operating system (0/S) to control the storage unit 110, the detecting unit 130, and the interface unit 140. In such case, the controlling unit 120 may be embodied as a central processing unit (CPU) capable of executing an O/S, or may include such CPU therein.

Accordingly, the replaceable unit 100 may carry out the overall operations such as detection of the operation environment, detection of the corresponding driving conditions, or transfer of the driving conditions, in accordance with its separately-provided O/S.

The O/S may be separately provided to drive the replaceable unit 100, and may be the software to operate the general programs. If such O/S is installed, the controlling unit 120 is capable of carrying out an initialization process, verification between image forming apparatus and main body, or encrypted data communications on its own.

The controlling unit 120 may carry out initialization in certain events, for example, upon power-on of the image forming apparatus having the replaceable unit 100 therein, or upon re-mounting of the replaceable unit 100. The initialization process includes various sub-processes such as initial driving of various application programs, computation of secret information (such as encryption values) that is required for data communication with the image forming apparatus after initialization, replacement period check, setting of internal register values of the replaceable unit 100, or setting of internal and external clock signals.

The 'setting of register values' refers to the operation of setting internal register values of the replaceable unit 100, according to which the replaceable unit 100 can operate in various function states as previously set by a user. Additionally, the 'setting of clock signal' refers to the operation of adjusting the frequency of an external clock signal provided from the main controller of the image forming apparatus to an internal clock signal used by the controlling unit 120 of the replaceable unit 100.

Additionally, the 'replacement period check' may include an operation of checking the amount of remaining toner or ink, estimating an end of life, and notifying the main controller of the results. Many other types of initialization are also possible according to types and characteristics of the replaceable unit 100 if the replaceable unit 100 includes its own O/S therein.

Since the above-described initialization concerns the replaceable unit 100 alone, the initialization may be carried out separately from the initialization at the main controller of the image forming apparatus. As a result, the system can accelerate the initialization process. Meanwhile, the controlling unit 120 may not respond to the command of the main controller until the initialization is completed. In this case, the main controller may periodically transmit a command and wait for a response.

Since the replaceable unit 100 has the controlling unit 120 which is capable of driving its own O/S, it is possible to carry out a variety of operations such as detecting appropriate driving conditions according to different operation environments and providing the detected driving conditions to the main body of the image forming apparatus, or performing initialization, verification, or encrypted data communications.

Figure 2:
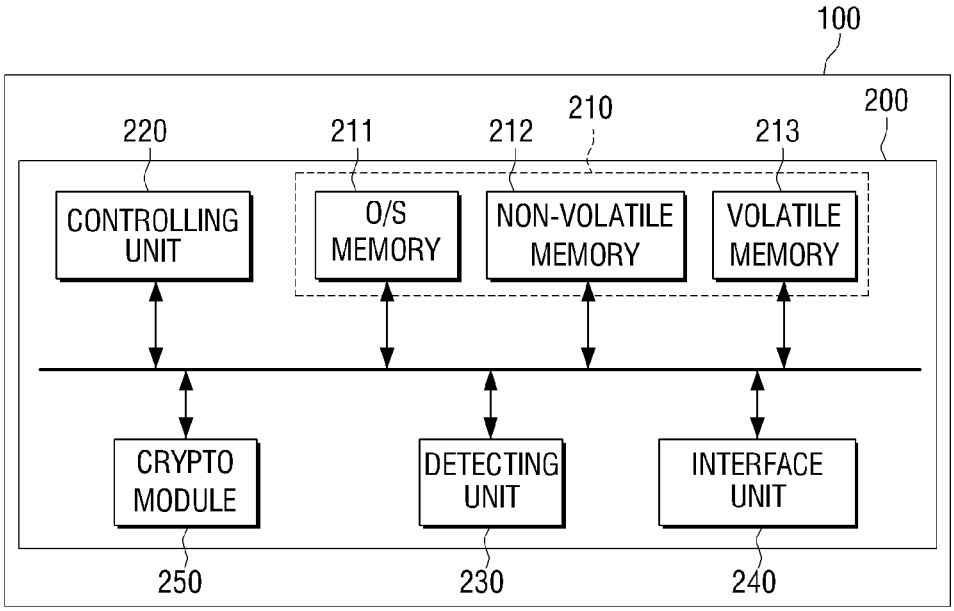
FIG. 2 illustrates a block diagram of a customer replaceable unit monitor (CRUM) unit according to an exemplary embodiment of the present general inventive concept.

FIG. 2 illustrates a block diagram of a customer replaceable unit monitor (CRUM) unit 200 according to an exemplary embodiment of the present general inventive concept. Referring to FIG. 2, the replaceable unit 100 may include a customer replaceable unit monitor (CRUM) unit 200 to control the operation of the replaceable unit 100 and manage the operation state of the replaceable unit 100. The CRUM unit 200 may include therein the structure illustrated in FIG. 1.

Accordingly, the CRUM unit 200 may include a storage unit 210, a controlling unit 220, a detecting unit 230, an interface unit 240, and a crypto module 250. The CRUM unit 200 may further include a clock unit (not illustrated) to output a clock signal, or a random value generating unit (not illustrated) to generate a random value for verification purposes. Some components may be omitted or included in the other components.

The crypto module 250 may support an encryption algorithm so that the controlling unit 220 can perform verification or encryption communication with the main controller. The crypto module 250 may support encryption algorithms such as ARIA, TDES, SEED, and AES symmetrical key algorithms. To do this, the main controller may be configured to support some or all of the encryption algorithms as well. Accordingly, the main controller can analyze the encryption algorithm or algorithms used in the CRUM unit 200, process the verification based on the encryption algorithm, and carry out encryption communication. As a result, the CRUM unit 200 can be easily mounted to the image forming apparatus and process encryption communication regardless of the encryption algorithm that the key of the CRUM unit 200 applies.

As explained above with reference to FIG. 1, the detecting unit 230 may include a tamper detector. If both of the crypto module 250 and the tamper detector (as the detecting unit 230) are employed, a systematic data security, which utilizes both hardware and software, may be enabled.

Referring to FIG. 2, the storage unit 210 may include an O/S memory 211, a non-volatile memory 212, and a volatile memory 213.

The O/S memory 211 may store therein an O/S to operate the replaceable unit 100 or the CRUM unit 200. The non-volatile memory 212 may be used as a permanent storage space which retains stored information even when not powered. The volatile memory 213 may be used as a temporary storage space.

Although the memory unit 200 is depicted as including the O/S memory 211, the non-volatile memory 212, and the volatile memory 213 in FIG. 2, some or all of the memory may be embodied as an internal memory housed in the controlling unit 220. Unlike the general memories, these memories 211, 212, 213 may be designed for security purposes such as address/data line scrambling or bit encryption.

The non-volatile memory 212 may store various information such as an electronic signature, various encryption algorithm information, status information regarding the replaceable unit 100 (e.g., amount of remaining toner, replacement period information, or number of printable pages remaining), identification information (e.g., manufacturer, date or time of manufacture, serial number, or model name), or maintenance service information.

Specifically, the non-volatile memory 212 may store therein a database regarding an operation environment and driving conditions such as the example shown in Table 1, or a database regarding the detection value of the detecting unit 230 and the corresponding driving conditions.

Further description of the operations of the controlling unit 220, the detecting unit 230, and the interface unit 240, correspond to the operations of the controlling unit 120, the detecting unit 230, and the interface unit 240 of FIG. 1, are omitted for conciseness.

Figure 3:
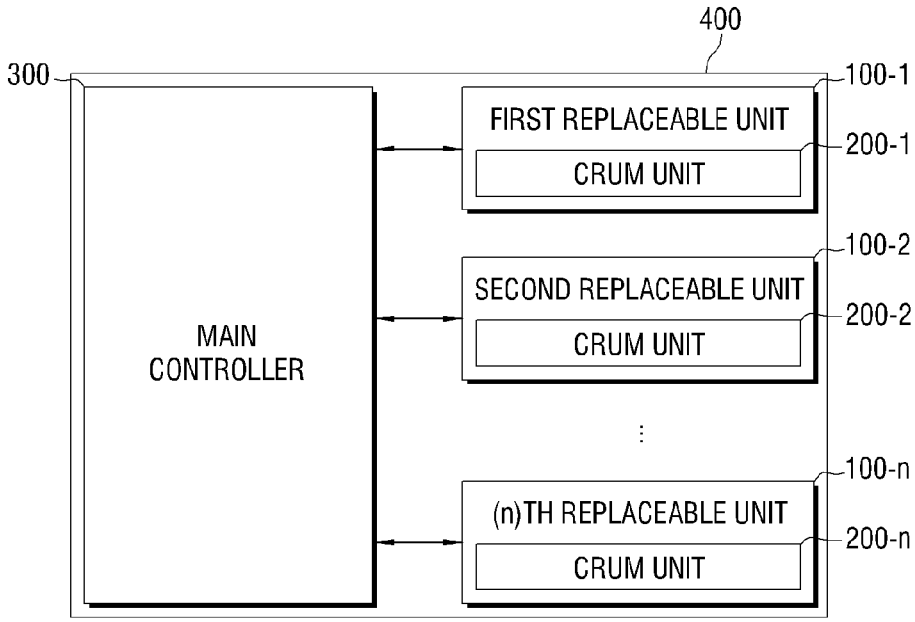
FIG. 3 illustrates a block view of an image forming apparatus according to an exemplary embodiment of the present general inventive concept.

FIG. 3 illustrates a block view of an image forming apparatus according to an exemplary embodiment of the present general inventive concept. Referring to FIG. 3, the image forming apparatus includes a plurality of replaceable units **100-1~100-*n*, and a main controller 300**.

The plurality of replaceable units **100-1~100-*n* are arranged in appropriate positions inside the image forming apparatus 400**, according to the order of image forming processes. Accordingly, the information regarding the driving conditions appropriate for the respective operation environments, which are computed from the respective positions, is stored in advance.

If a color printer is used, four color cartridges, such as cyan (C), magenta (M), yellow (Y) and black (K) cartridges may be mounted. Other consumables may also be mounted as necessary. If a plurality of replaceable units **100-1~100-*n* is used, it is inefficient to provide input/output (I/O) interfaces for each one of the replaceable units 100-1~100-*n*. Instead, the replaceable units 100-1~100-*n* may be connected to the main controller 300 using one serial I/O channel. In this case, the main controller 300 can access the replaceable units 100-1~100-*n*, using individual addresses given to the replaceable units 100-1~100-*n***.

The main controller 300 may have separate, unique electronic signature information which is individually set for each of the replaceable units **100-1~100-*n*, and is thus capable of performing verification or encryption data communication with the replaceable units 100-1~100-*n***.

Each of the replaceable units **100-1~100-*n* may include CRUM unit (200-1~200-*n*). In other words, the replaceable units 100-1~100-*n* may be embodied based on the structure illustrated in FIG. 1 or FIG. 2**.

The replaceable units **100-1~100-*n* can monitor the operation environments on their own, and can provide the main controller 300 with the individual driving conditions that correspond to the results of monitoring. If the replaceable units 100-1~100-*n* of FIG. 3 are embodied according to the example illustrated in FIG. 2, each CRUM unit (200-1~200-*n*) of the replaceable units 100-1~100-*n* can compute the driving condition that suits the individual operation environment, and can provide the main controller 300** with the result.

As described above, since the detecting unit (130, 230) housed in the replaceable units **100-1~100-*n* is capable of performing monitoring of the operation environment, the most exact operation environment at the positions of the replaceable units 100-1~100-*n* can be obtained without requiring a separate thermistor, and as a result the replaceable units 100-1~100-*n*** can be driven under optimum conditions.

Furthermore, since the replaceable units **100-1~100-*n* are capable of computing the driving conditions that correspond to the operation environments on their own and notifying the main controller 300 of the result, it is unnecessary for the main controller 300 to compute the driving conditions of the replaceable units 100-1~100-*n***, and as a result computational load can be reduced.

The main controller 300 may drive the replaceable units **100-1~100-*n* according to the driving conditions provided from the replaceable units 100-1~100-*n*. For example, if the first replaceable unit 100-1 is a developer, and the second replaceable unit 100-2 is a fuser, the first replaceable unit 100-1 can provide the main controller 300 with the voltage information necessary for the driving of the developer, and the second replaceable unit 100-2 can provide the main controller 300 with the information of the voltage to be supplied to the fuser heating roller and fuser pressing roller. Accordingly, the main controller 300 may control a power unit (not illustrated) to supply voltage or current for driving that is suitable for the driving voltage conditions computed by the replaceable units 100-1~100-*n***.

Additionally, the main controller 300 may check the consumable information supplied from the replaceable units **100-1~100-*n* to display a message of replacement period notification, or to transmit the data to the replaceable units 100-1~100-*n***.

Although FIG. 3 illustrates a plurality of replaceable units **100-1~100-*n***, only one single replaceable unit may carry out the abovementioned operations of detecting driving conditions and transmitting the result.

Figure 4:
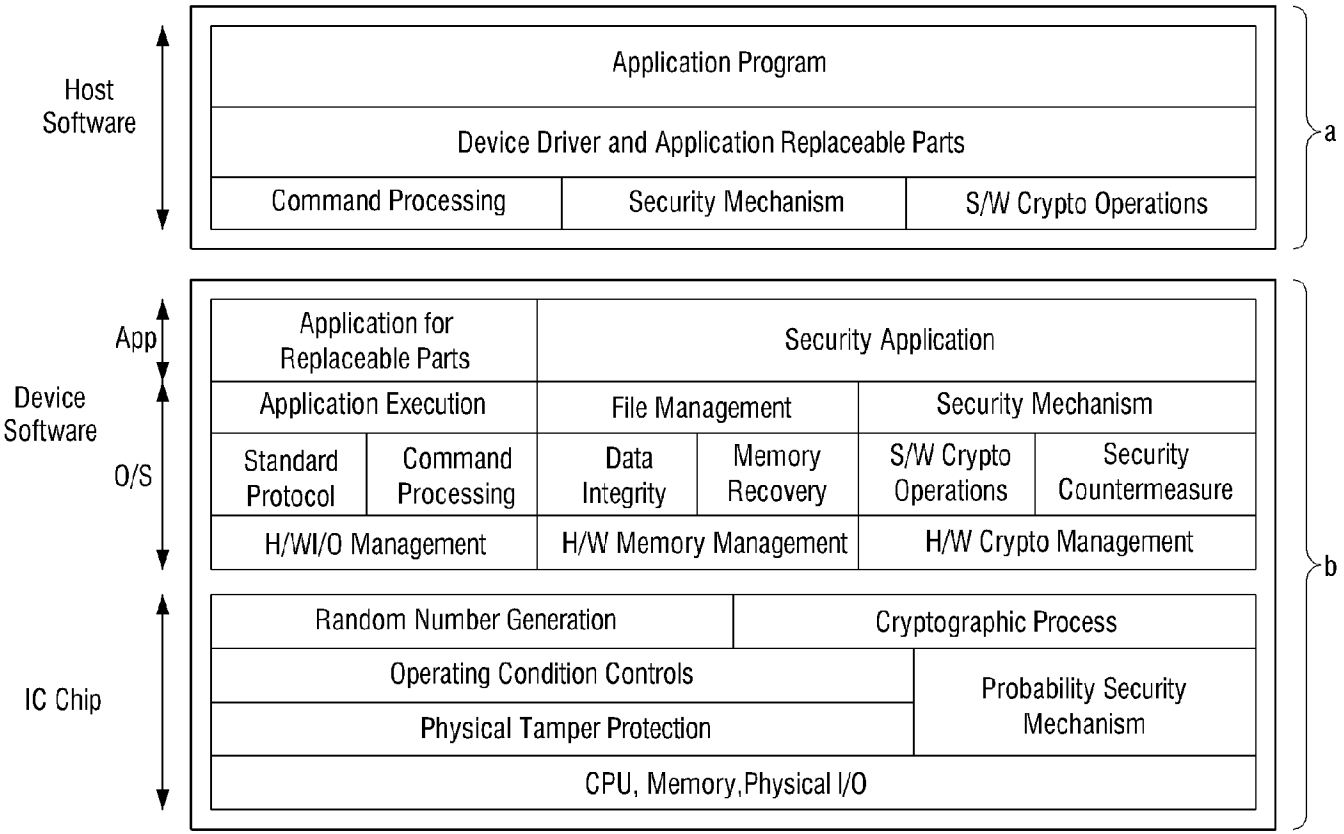
FIG. 4 illustrates an exemplary software structure used in a CRUM unit, a replaceable unit and an image forming apparatus according to an exemplary embodiment of the present general inventive concept.

FIG. 4 illustrates an exemplary software structure used in a a CRUM unit, a replaceable unit and an image forming apparatus according to an exemplary embodiment of the present general inventive concept.

Referring to FIG. 4, the software (a) of the image forming apparatus 400 may additionally include a security mechanism to perform verification and encryption with the replaceable units **100-1~100-*n***, and a S/W crypto operation region to perform encryption operations on a software level, as well as the applications for data management, device driver for direct management, and command processing programs.

Meanwhile, the software (b) of the replaceable units **100-1~100-*n*** may include an IC chip region having a plurality of blocks for data protection purpose, an App region for interface with host software, and an O/S region to operate the above regions.

FIG. 4 illustrates the basic components of the O/S for file management and an operating block for data protection in the area of device software of FIG. 4. Briefly, the programs may be divided into a hardware control program to form a security system, an application program using the hardware control program, and a tamper-proofing program. Since the application program is loaded on the above programs to realize the CRUM function, it is impossible to check the content of the actual data in the communication channel. Although the programs including the basic components can be designed based on the other structures, for an efficient data protection, careful programming on an O/S level is required.

Figure 5:
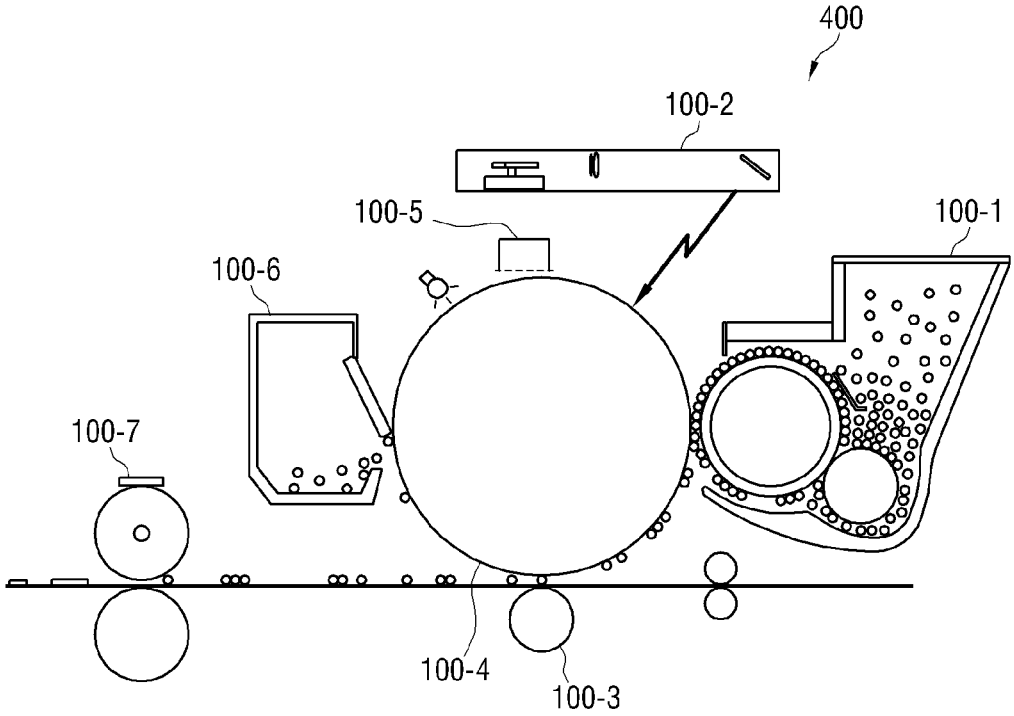
FIG. 5 is a schematic view provided to explain the structure of an image forming apparatus according to an exemplary embodiment of the present general inventive concept.

FIG. 5 is a schematic view provided to explain the structure of an image forming apparatus according to an exemplary embodiment of the present general inventive concept. Referring to FIG. 5, the image forming apparatus 400 may include a variety of replaceable units, such as a developing unit 100-1, a laser scanning unit (LSU), a transfer unit 100-3, an OPC 100-4, a charging unit 100-5, a cleaning unit 100-6, and a fusing unit 100-7.

Referring to FIG. 5, a printing sheet shown in a thick horizontal line is moved from a left-hand side to the right-hand side of the drawing. The surface of the OPC 100-4 is charged by the charging unit 100-5, so that a latent image is formed on the charged surface by the operation of the LSU 100-2. As the developing unit 100-1 starts developing, toner is attached to the latent image, and the toner image is transferred onto the printing sheet by the transfer unit 100-3. The toner is affixed on the printing sheet by the fusing unit 100-7. The small blank dots in FIG. 5 represent toner particles.

At least some of the replaceable units may include the controlling unit 120, 220 and the storage unit 110, 210 as shown in FIG. 1 or FIG. 2. Accordingly, it is possible to compute the optimum driving conditions individually, using the driving conditions corresponding to each of the operation environments which are set from the respective positions. As a result, the main controller 300 can have minimized computational load, while the high quality image is obtained.

Figure 6:
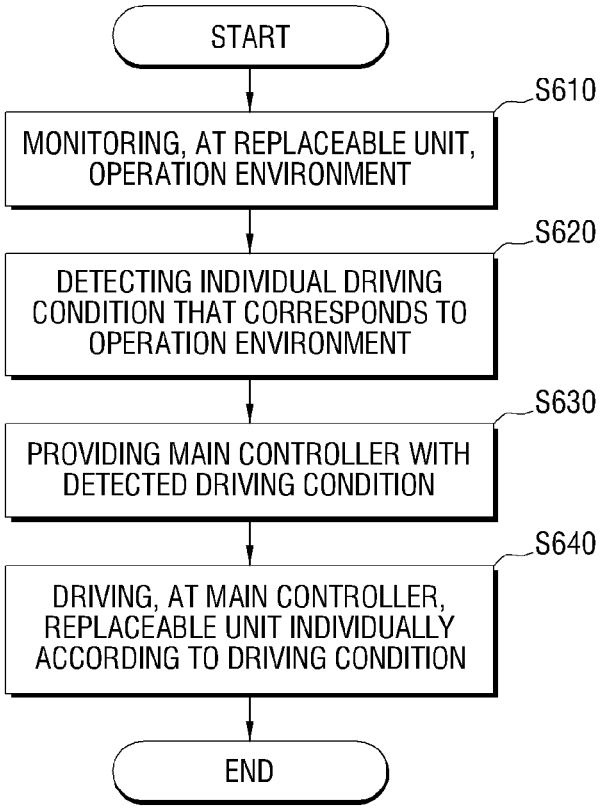
FIG. 6 is a flowchart illustrating a unit driving method of an image forming apparatus according to an exemplary embodiment of the present general inventive concept.

FIG. 6 is a flowchart illustrating a unit driving method of an image forming apparatus according to an exemplary embodiment of the present general inventive concept.

Referring to FIG. 6, the replaceable units monitor the operation environments at operation S610, and detect the driving conditions, that is, driving voltage information according to the result of monitoring at operation S620.

Each of the replaceable units transmits the detected driving conditions to the main controller 300 at operation S630. The main controller 300 individually drives the replaceable units according to the received driving conditions at operation S640.

As described above, the operation environments may be temperature information, but this is not limiting. Accordingly, the operation environments may be humidity or other environment information. Furthermore, the driving conditions may also include current value, or pulse duty ratio, as well as or instead of voltage.

Although a few exemplary embodiments of the present general inventive concept have been shown and described, it will be appreciated by those skilled in the art that changes may be made in these exemplary embodiments without departing from the principles and spirit of the general inventive concept, the scope of which is defined in the appended claims and their equivalents.

What is claimed is:

1. A consumer replaceable unit monitor (CRUM) unit mountable to a replaceable unit of an image forming apparatus, the CRUM unit comprising:

a storage unit to store an O/S (Operating System) for operating the replaceable unit and driving conditions with regard to the replaceable unit;

a detecting unit to monitor a temperature of a location of the replaceable unit in the image forming apparatus;

a CPU to operate and manage the replaceable unit by using the O/S, separately from a main controller of the image forming apparatus, wherein the driving conditions comprise a plurality of driving voltage information corresponding to a plurality of temperature ranges, if a variation of an operation environment is detected by the detecting unit, the CPU reads and extracts the driving voltage information corresponding to the detected temperature voltage among the plurality of driving voltage information stored in the storage unit and transmits the extracted driving voltage information to the main controller of the image forming apparatus via a serial interface.

2. The CRUM unit of claim 1, wherein the detecting unit comprises a tamper detector to obtain temperature information from a tamper detecting operation and provide the obtained temperature information to the CPU.

3. An image forming apparatus, comprising:

at least one replaceable unit to participate in an image forming job of the image forming apparatus; and a main controller to communicate with the at least one replaceable unit and to control the image forming job, wherein the at least one replaceable unit comprises:

a storage unit to store an O/S (Operating System) for operating the replaceable unit and driving conditions with regard to the replaceable unit; and a CPU to operate and manage the replaceable unit by using the O/S, separately from a main controller of the image forming apparatus, wherein the driving conditions comprise a plurality of driving voltage information corresponding to a plurality of temperature ranges, and the CPU checks a temperature of a location of the replaceable unit in the image forming apparatus, determines a driving voltage information corresponding to the checked temperature among the plurality of driving voltage information stored in the storage unit and transmits the determined driving voltage information to the main controller.

4. The image forming apparatus of claim 3 wherein the at least one replaceable unit further comprises a tamper detector to obtain temperature information from a tamper detecting operation and provide the obtained temperature information to the CPU.

* * * * *